US005898949A

United States Patent [19]

Barthold et al.

[11] Patent Number: 5,898,949

[45] Date of Patent: May 4, 1999

[54] HEAD-PROTECTIVE HELMET MOUNTING MEMBER FOR MOUNTING HELMET COMPONENTS TOGETHER AND HEAD BAND

[75] Inventors: Michael J. Barthold, Flemington; Louis Orotelli, Washington Township, both of N.J.

[73] Assignee: Cairns & Brother Inc., Clifton, N.J.

[21] Appl. No.: 08/886,787

[22] Filed: Jul. 1, 1997

[51] Int. Cl.[6] ..... A42B 3/14

[52] U.S. Cl. ..... 2/416; 2/5; 2/411

[58] Field of Search ..... 2/410, 411, 416, 2/417, 418, 419, 420, 421, 5, 8, 9, 414; 24/453, 583, 587, 711.1

[56] References Cited

U.S. PATENT DOCUMENTS

| | | | |
|---|---|---|---|
| 3,156,922 | 11/1964 | Anderson | 2/419 |
| 3,516,092 | 6/1970 | Raschke | 2/416 |
| 3,555,560 | 1/1971 | Rascke | 2/416 |
| 4,055,860 | 11/1977 | King | 2/416 |
| 4,463,456 | 8/1984 | Hanson | 2/416 |
| 4,527,290 | 7/1985 | Zahn | 2/416 |
| 5,044,016 | 9/1991 | Coombs | 2/414 |
| 5,044,019 | 9/1991 | Shewchenko et al. | 2/421 |
| 5,077,836 | 1/1992 | Idoff et al. | 2/417 |
| 5,079,780 | 1/1992 | Coombs et al. | 2/420 |
| 5,150,479 | 9/1992 | Oleson | 2/414 |
| 5,517,591 | 5/1996 | Blake | 2/5 |
| 5,555,569 | 9/1996 | Lane | 2/5 |

*Primary Examiner*—Michael A. Neas
*Attorney, Agent, or Firm*—R. Gale Rhodes, Jr.

[57] ABSTRACT

Head-protective helmet including a single mounting means, e.g. a plurality of anchor clips, which at least assist in mounting an inner impact shell to the outer shell, mount a head band to the outer shell, mount a plurality of head straps to the outer shell, and depending upon the material of which the mounting means is made may absorb energy created upon a downwardly acting force being applied to the outer shell. A head band including pivotally interconnected forehead member and nape device. A mounting member particularly useful for mounting head-protective helmet components together.

42 Claims, 5 Drawing Sheets

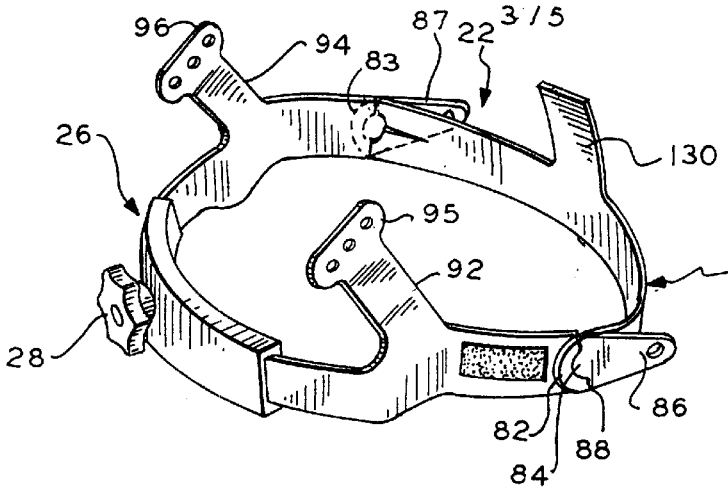
FIG. 6
FIG. 7
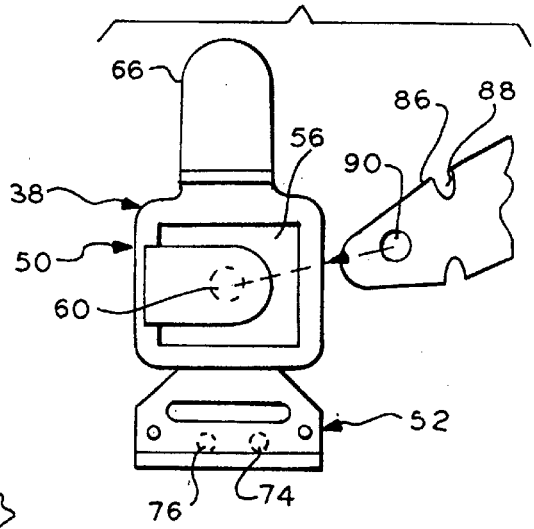
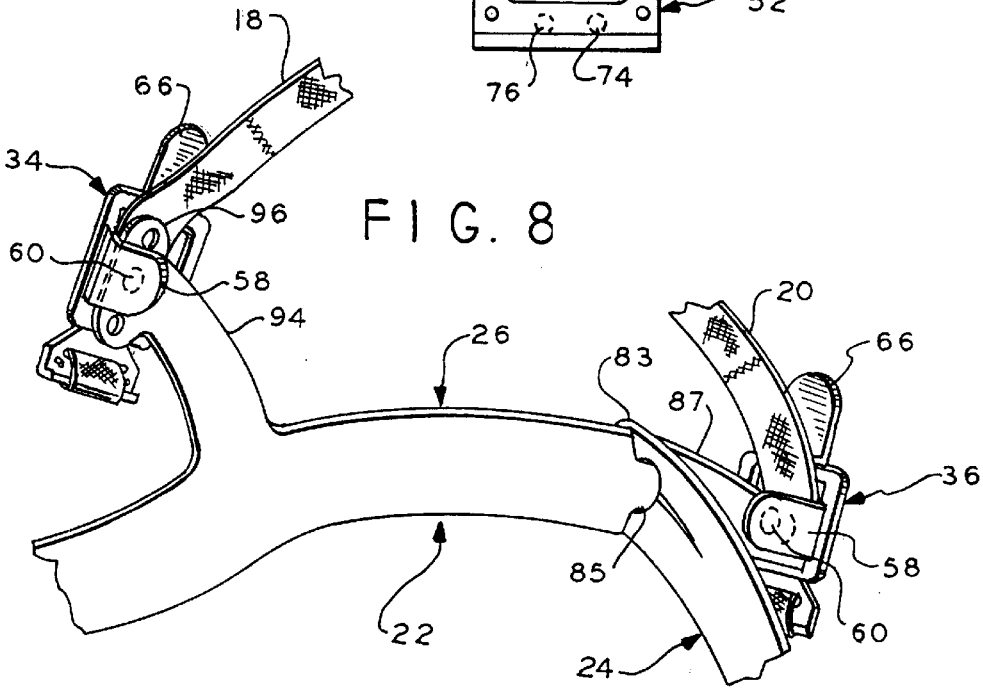
FIG. 8

HEAD-PROTECTIVE HELMET MOUNTING MEMBER FOR MOUNTING HELMET COMPONENTS TOGETHER AND HEAD BAND

BACKGROUND OF THE INVENTION

This invention relates generally to a new and improved head-protective helmet and more particularly relates to a new and improved head-protective helmet which may be embodied as a firefighter's helmet, a head-protective helmet for EMS personnel, firemen, policemen, and the like. This invention also relates to a new and improved mounting member particularly useful for mounting head-protective helmet components together. This invention further relates to a new and improved head band particularly useful for mounting to a head-protective helmet.

By way of example, firefighters' helmets are known to the prior art which include an outer shell, an inner impact cap or inner impact attenuation shell mounted to the interior of the outer shell, a cradle or web of head straps which extends into the inner impact cap and is for engaging the head of a wearer of the helmet, and a head band for being fitted to the head of a wearer of a helmet. Such a firefighter's helmet is disclosed in U.S. Pat. No. 4,286,339 entitled FIREMAN'S HELMET WITH ENERGY ABSORBING LINER, patented Sep. 1, 1981, Peter A. Coombs inventor; this patent is incorporated herein by reference as if fully reproduced herein. The firefighter's helmet disclosed in this patent includes an outer shell 10 in which is mounted an inner non-resilient foam liner 20, sometimes referred to in the art as an inner impact cap or shell, a head band 40 attached to the liner by an adjustable system of holes and snap buttons 44, 45 on tab extensions 46, and a cradle of head web straps 32–33 mounted to the inner impact liner or cap 20 by a tube 25.

Another firefighter's helmet including in the above-noted firefighter helmet components is disclosed in U.S. Pat. No. 5,044,016 entitled PROTECTIVE HELMET ASSEMBLY INCLUDING RELEASABLE HEAD RETAINING ASSEMBLY, patented Sep. 3, 1991, Christopher E. Coombs inventor; this patent is incorporated herein by reference as if fully reproduced herein. The helmet components of the firefighter's helmet disclosed in this patent are mounted together in substantially the same manner as the elements of the firefighter's helmet disclosed in the above-referenced 4,286,339 patent, except that additionally a plurality of retaining clip members 70 are mounted to the brim of the outer shell 12 and engage the rim 42 of the foam liner or inner impact cap or shell 26 to maintain the inner impact cap within the outer shell below a predetermined load exerted on the inner liner by the head straps engaging the user's head due to a blow or load being applied to the outer shell. The helmet disclosed in this patent includes an adjustable head band 32 lined with a sweat band 34; the head band 32 is attached to the foam liner 26 by an adjustable system of holes 36 and snap buttons 38.

As taught in detail in the above-referenced patents, the inner impact cap or foam liner and the manner of mounting the cradle or web of head straps to the inner impact cap or shell attenuate or absorb impact energy or force transferred to the wearer's head upon, for example, an object striking the outer shell.

While the firefighters' helmets disclosed in the above-referenced patents have performed well, there still exists a need in the art for a new and improved head-protective helmet which may be advantageously embodied as a firefighter's helmet, or other helmet of the types noted above, and which head-protective helmet includes a single mounting means for mounting the firefighter helmet components together. And, while the head bands disclosed in the above-referenced patents incorporated herein by reference have performed well, there still exists a need in the art for a new and improved head band which is particularly useful for mounting to a head-protective helmet. There also exists a need in the art for a mounting member which is particularly useful for mounting head-protective helmet components together.

SUMMARY OF THE INVENTION

It is the object of the present invention to satisfy the foregoing needs in the art.

A head-protective helmet embodying the present head-protective helmet invention and satisfying the foregoing need includes a single mounting means which may be embodied as a plurality of anchor clips which at least assist in mounting the inner impact shell to the outer shell, mount the plurality of head straps to the outer shell, mount a head band to the outer shell, and, depending upon the material of which the mounting member is made, absorbs at least a portion of the energy created upon a force, such as from a falling object, being applied to the outer shell.

A head band including a forehead member and a nape device mounted together for pivotal movement with respect to each other.

A mounting member satisfying the foregoing need and embodying the present invention may include integrally formed first and second portions, the first portion including an outer rectangular portion and an inner trapezoidal portion formed integrally with the second portion, the second portion including an inner generally rectangular frame having a hollow interior and including a lateral frame leg, a first tab formed integrally with and extending generally inwardly from the lateral frame leg over the hollow interior, the first tab provided with an outwardly extending split snap button, the second portion further including an outer second tab formed integrally with and extending outwardly from the frame generally opposite the first portion.

DESCRIPTION OF THE DRAWINGS

FIG. 6 is a perspective view of a head band embodying the present head band invention and including an assembled forehead member and nape device;

FIG. 7 is an exploded diagrammatical view illustrating the mounting of one end of a nape device to an anchor clip;

FIG. 8 is a partial perspective view showing a nape device mounted to a pair of anchor clips;

DESCRIPTION OF THE PREFERRED EMBODIMENT

Figure 1:
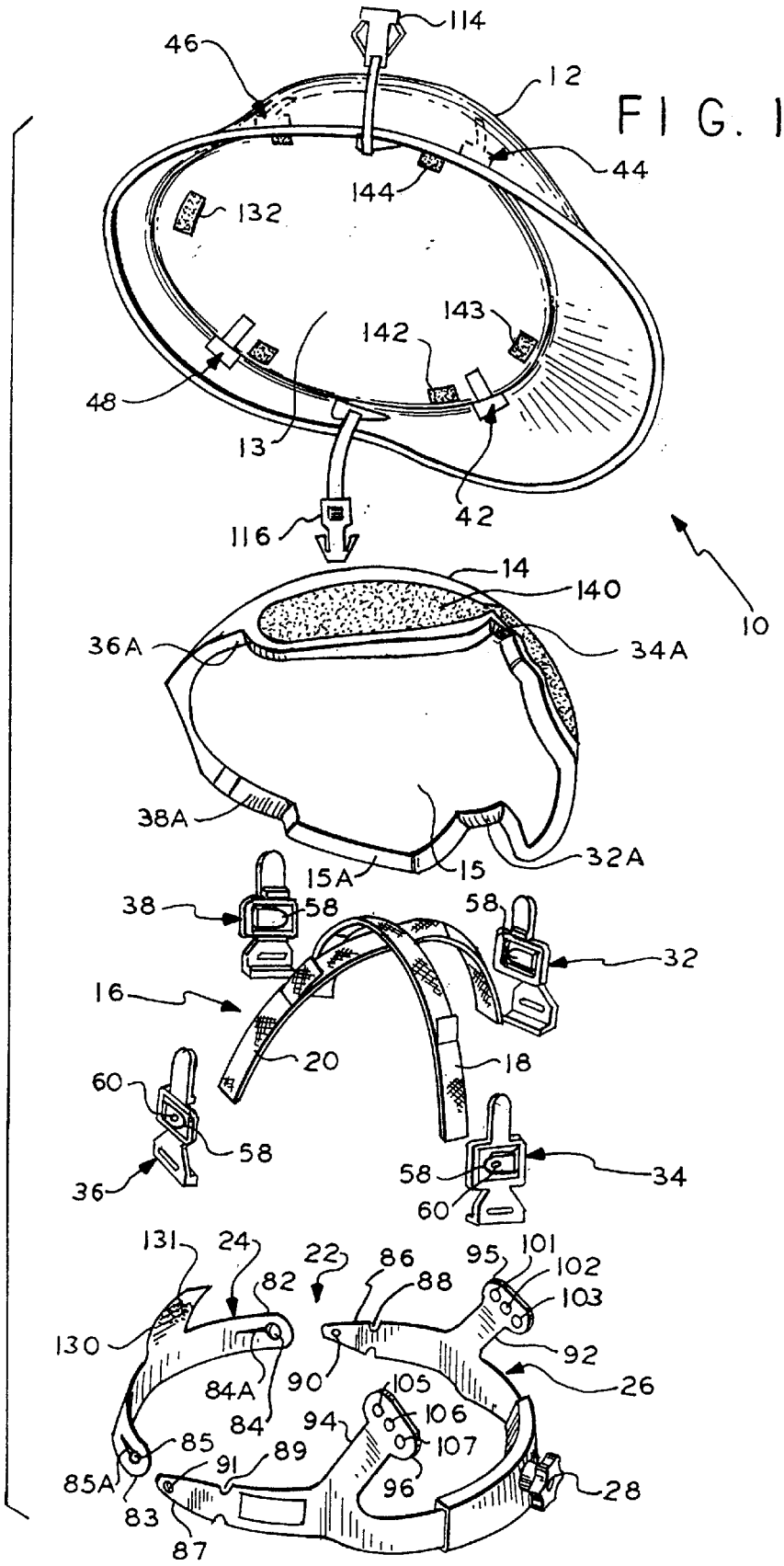
FIG. 1 is an exploded view of a firefighter's helmet embodying the present head-protective helmet invention.

The preferred embodiment of the head-protective helmet of the present invention shown in the drawings and described herein is that of a firefighter's helmet, but it will be understood that the present invention is not so limited and that the disclosure of a firefighter's helmet embodiment is merely by way of example. Referring now to FIG. 1, a firefighter's helmet is shown in exploded view embodying the present invention and indicated by general numerical designation 10. Firefighter's helmet 10 includes an outer shell 12 having an interior 13, an inner impact shell or cap 14 having an exterior complementary in shape to the interior of the outer shell and having an interior 15 and terminating in an irregularly shaped outer edge 15A, a cradle or web of head straps indicated by general numerical designation 16 and which includes a pair of crossed head straps 18 and 20 generally disposed at 90° with respect to each other, a head band indicated by general numerical designation 22 which head band includes a generally semi-circular brow or forehead member indicated by general numerical designation 24 and a generally semi-circular nape device indicated by general numerical designation 26, and a plurality of anchor clips indicated by general numerical designations 32, 34, 36 and 38; the head band 22 is shown disassembled in FIG. 1. The nape device 26 includes a rotatable ratchet knob 28 for varying the length of the nape device 26, in the manner known to the art, to fit the nape device to the nape of the head of a wearer of the helmet which in turn fits the head band 22 to the head of the wearer of the helmet. It will be generally understood that the plurality of anchor clips 32, 34, 36 and 38, as described in detail below, are mounted respectively in a plurality of sockets formed in the outer shell 12 and indicated by general numerical designations 42, 44, 46 and 48. It will be further generally understood, and as described in detail below, that the anchor clips 32, 34, 36 and 38 at least assist in mounting the inner impact shell or cap 14 to the outer shell 12 so as to reside in the outer shell interior 13, mount the cradle or web of head straps 16 to the outer shell 12 so as to extend into the inner impact cap interior 15 for engagement by the head of the wearer of the helmet, mount the head band 22 to the outer shell 12, and, depending upon the material of which the anchor clips are made attenuate or absorb at least a portion of the impact energy created when a force such as a downward force is applied to the outer shell 12 such as, for example, upon a falling object striking or impacting the outer shell 12. In the preferred embodiment, as taught in detail below, the anchor clips are made of material which causes the anchor clips to attenuate or absorb at least a portion of such impact energy. It will be understood that the inner impact cap 14 will perform its force or energy absorbing function in the manner known to the art and as described above in the Background of the Invention.

Figure 2:
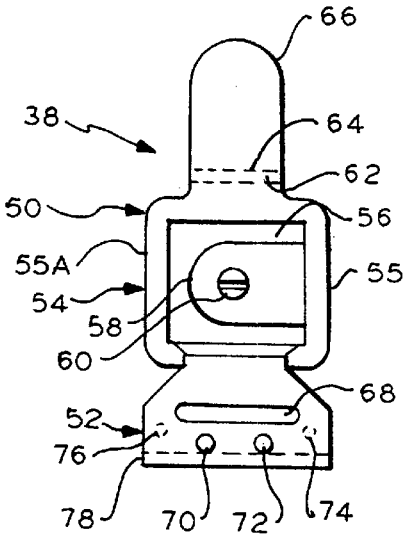
FIG. 2 is a front view of an anchor clip embodying the present mounting member invention.
Figure 3:
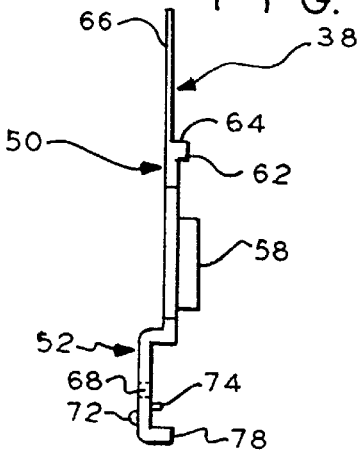
FIG. 3 is a right side view of FIG. 2.
Figure 4:
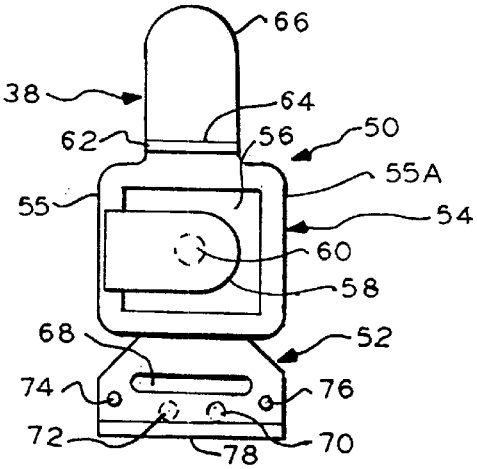
FIG. 4 is a rear view of FIG. 2.

The detailed structure of representative anchor clip 38 is shown in FIGS. 2–4. As viewed in these FIGS., anchor clip 38 includes an upper portion indicated by general numerical designation 50 and a lower portion indicated by general numerical designation 52. The upper portion 50 includes a frame indicated by general numerical designation 54 including opposed frame legs 55 and 55A and providing an opening 56, a tab 58 extending generally inwardly from frame leg 55 and generally inwardly over the opening 56, an outwardly extending cross member or projection 62 providing an inner impact cap engaging or mounting shoulder or mounting surface 64 and an upwardly extending stabilizing tab 66 extending upwardly opposite the lower portion 52; tab 58 is provided with a split snap button 60 of the type known to the art. The lower portion 52 is provided with an opening 68, a pair of outwardly extending spacer projections 70 and 72, a pair of outwardly extending mounting projections 74 and 76 best seen in FIG. 4, and a deformable cross member indicated by general numerical designation 78 and which cross member partially defines the opening 68. It will be understood from FIG. 1 that the anchor clips of the present invention are provided and function in identical pairs. More particularly it will be understood that anchor clips 38 and 34 are identical and that anchor clips 36 and 32 are identical. Anchor clips 36 and 32 are substantially the same as anchor clips 38 and 34 except that the projection 58 provided on anchor clips 36 and 32 extends generally inwardly from the frame leg 55A (note frame leg 55A shown in FIGS. 2 and 4) and generally inwardly over the opening 56 whereas, as noted above and shown in FIGS. 2–4 with regard to representative anchor clip 38, in anchor clips 38 and 34 the projection 58 extends generally inwardly from the frame leg 55 and generally inwardly over the opening 56.

Figure 5:
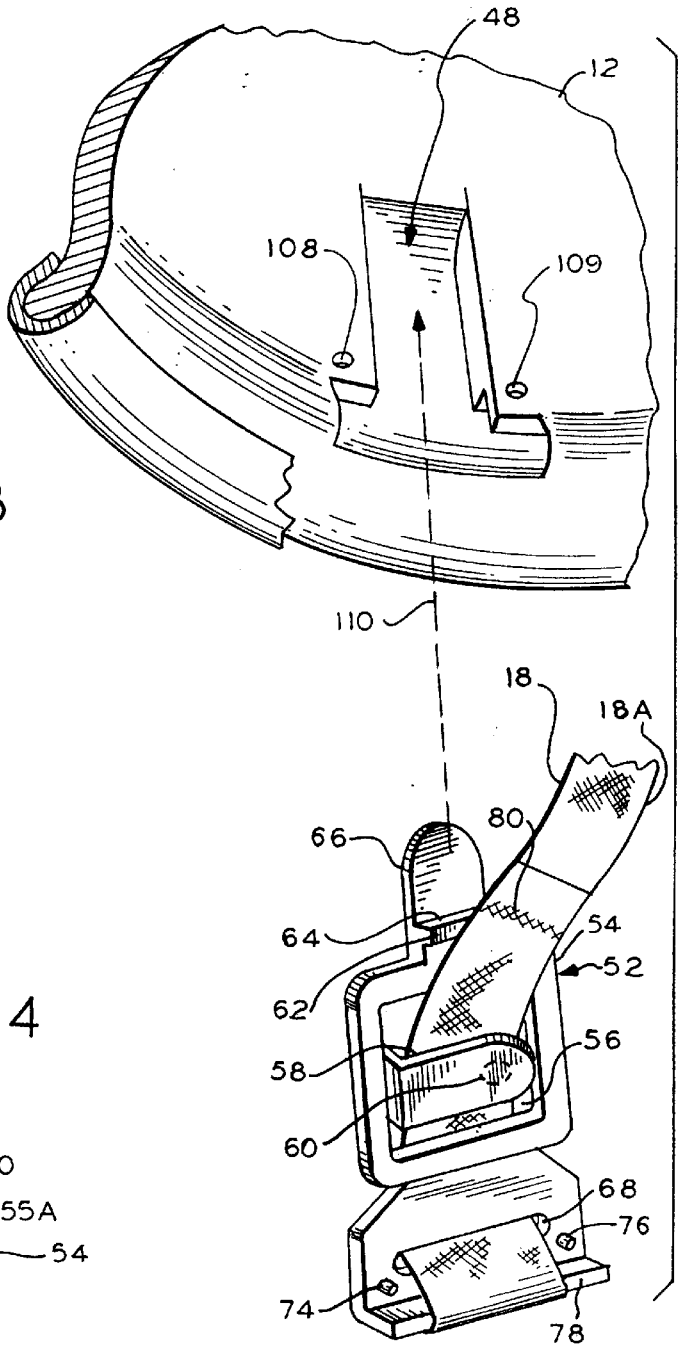
FIG. 5 is an exploded partial view illustrating diagrammatically the insertion of an anchor clip into a socket formed in the outer helmet shell.

The ends of the head straps 18 and 20 are mounted to the anchor clips 32, 34, 36 and 38 as will be understood by reference to FIG. 5 and representative anchor clip 38 and the strap end 18A of representative head strap 18. The head strap end 18A is inserted, as viewed in the lower portion of FIG. 5, downwardly through the opening 56 and behind a portion of the anchor strap 38 and outwardly through the opening 68, around the deformable cross member 78 and upwardly behind a portion of the anchor clip 38 and through the opening 56 and then sewn upon itself as indicated by the sewing line 80 in FIG. 5.

Referring now to the mounting of the head band 22 to the anchor clips 32 . . . 38, the head band forehead portion 24 and nape device 26 are first assembled. The generally semi-circular forehead member or portion 24, FIG. 1, includes inner ends 82 and 83 provided, respectively, with circular openings 84 and 85, and the generally semi-circular nape device 26 includes pointed or triangular inner ends 86 and 87 which are inserted into the circular openings 84 and 85 to mount the forehead portion 24 and the nape device 26 together and pivotally with respect to each other. More specifically, the forehead portion inner ends 82 and 83 also are provided, respectively, with slits or slots 84A and 85A opening into the circular openings 84 and 85 and the inner triangular ends 86 and 87 of the nape device are aligned or oriented substantially co-planar with the slots 84A and 85A and inserted therethrough and then rotated to align the nape device 26 generally circularly with respect to the forehead portion 24 and to complete the assembly of the head band 22. The inner ends of the nape device 26 are provided with notches or reduced thickness portions or indentations 88 and 89 for receiving the outer ends 82 and 83 of the forehead portion 24 which facilitates mounting of the forehead portion 24 and the nape device 26 pivotally with respect to each other. The assembled forehead member 24 and nape device 26 are shown in FIG. 6 and are shown comprising the head band 22 upon assembly It will be generally understood that the reason the forehead portion 24 and nape device 26 of the head band 22 are mounted pivotally with respect to each other is to permit the head band to better fit the forehead and the nape of the head of a wearer of the helmet 10. More specifically, the forward portion of the forehead portion 24, FIG. 1, is provided with an upwardly extending tab or projection 130 provided on its exterior with one of a hook or loop patch 131 and the forward interior portion of the outer shell 12 is provided with the other of a hook and loop patch 132. In use the forehead portion 24 is pivoted with respect to the nape device 26, and the hook or loop patch 131 is engaged with different portions of the loop or hook patch 132 to mount the forehead portion at different heights with respect to the outer shell 12 and thereby with respect to the forehead of a wearer of the helmet 10. The nape device 26 includes upwardly extending members 92 and 94 provided at the rearward portion of the nape device 26 and angularly disposed members 95 and 96 provided, respectively, at the ends of the members 92 and 94. It will be noted that the angular members 95 and 96 are provided, respectively, with holes or three openings 101–103 and 105–107. From FIG. 1, it will be noted that these openings are at different heights or levels, and it will be understood that these openings function in associated pairs, i.e. holes 101 and 105 are associated and function as a pair, holes 102 and 106 are associated and function as a pair, and holes 103 and 107 are associated and function as a pair. It will be generally understood that, in use, such associated pairs of holes receive the snap buttons provided respectively on anchor clips 32 and 34 to mount the angularly disposed members to such anchor clips; an example of this is provided in detail below with regard to FIG. 7. Upon the anchor clips 32 and 34 being mounted in the respective outer shell sockets 42 and 44 as described in detail below with regard to representative anchor clip 38 and FIG. 5, and upon the nape device 26 being pivoted with respect to the forehead portion 24, the angularly disposed nape device portions 95 and 96 are mounted at different heights with respect to the outer shell and thereby with respect to the nape of the head of a wearer of the helmet 10. The respective ends 86 and 87 of the nape device 26 are provided with openings 90 and 91 for receiving the split snap buttons of anchor clips 38 and 36. After the forehead portion 24 and the nape device 26 are assembled as described above to form the head band 22, the head band 22 is mounted to the anchor clips specifically by mounting the nape device 26 to the anchor clips.

With specific regard to the mounting of the nape device 26 to the anchor clips, this mounting will be described with regard to representative anchor clip 38 and the nape device end 86 shown in FIG. 7; for clarity of presentation, the end 82 of the forehead portion 24 to which the nape device end 86 is mounted is not shown in FIG. 6. It will be understood that prior to the snap fitting together of the anchor clip 38 and the nape device end 86, the head strap end 18A has been mounted to the anchor clip 38 as described above and shown in FIG. 5 but it will be further understood that such head band end also is not shown in FIG. 7 for clarity of presentation of the snap fitting action. As will be understood from FIG. 7, the pointed end 86 of the nape device is inserted into the anchor clip opening 56 and the snap button 60 of the anchor clip 38 is snap fitted into the opening 90 provided in the pointed end 86 to mount the nape device end 86 pivotally with respect to the anchor clip 38; more particularly, it will be understood that the snap fitting of the snap button 60 into the opening 90 is sufficiently positive to retain the anchor clip 38 and the end 86 of the nape device together but such snap fitting is sufficiently loose to permit pivotal movement between the anchor clip and the nape device thereby to enhance the pivotal movement of the nape device 26 with respect to the forehead portion 24 of the head band 22 for adjustable height mounting of the nape device as described above. Similarly, FIG. 1, the nape device pointed end 87 is mounted to the anchor clip 36 and, upon the level at which the nape device 26 is to be mounted with respect to the outer shell 12 and inner impact cap 14 being determined, an associated pair of openings provided in the angularly disposed members 95 and 96 are chosen, and the split snap buttons of anchor clips 32 and 34 are, respectively, snap fitted into these openings to mount the nape device 26 pivotally to the anchor clips 32 and 34. The angularly disposed nape device member 96 is shown in FIG. 8 mounted to the anchor clip 34 and the nape device inner end 87 is shown mounted to the anchor clip 36 in FIG. 8.

After the head straps 18 and 19 and head band 22 are mounted to the anchor clips as described above, the inner impact cap 14 is inserted into the interior 13 of the outer shell 12 and the anchor clips are inserted into the sockets formed in the outer shell to mount the head straps 16 and head band 22 to the outer shell and to at least assist in mounting the inner impact cap 14 to the outer shell 12. More particularly with regard to representative anchor clip 38 and representative socket 48 shown in FIG. 5, as indicated by the dashed outline arrow 110, the anchor clip 38 is oriented as shown in FIG. 5 and inserted into the socket 48. As will be understood from representative socket 48, mounting openings 108 and 109 are formed in the outer shell 12 adjacent the sockets for receiving the mounting projections 70 and 72 provided on the anchor clips, e.g. representative anchor clip 38. It will be understood that the size and dimensions of the lower portion 52 of the anchor clip 38 are such that such lower portion will be received in the socket 48 in a slight interference fit. Using suitable manually applied force, the lower portion 52 of the anchor clip 38 will be inserted into the socket 48 until the anchor clip mounting projections 74 and 76 provided on such lower portion project or snap into the mounting openings 108 and 109 formed in the outer shell 12 surrounding the socket 48. To assure that the mounting projections 74 and 76 remain in the mounting openings 108 and 109, the spacer projections 70 and 72 (note FIG. 4) engage the outer shell 12 and bias or space the anchor clip 38 forwardly toward the interior of the outer shell 12 assuring that the mounting projections 74 and 76 remain positioned in the mounting openings 108 and 109 formed in the outer shell. From FIG. 9, it will be understood that upon the representative anchor clip 38 being inserted into the representative outer shell socket 48, the inner impact cap mounting shoulder 64 provided on the cross member 62 engages the outer edge 15A of the inner impact cap 14 at least assists in mounting the inner impact cap 14 to the outer shell 12. Similarly, the other anchor clips 32, 34 and 36 are mounted in the respective sockets 46, 44 and 42. It will be understood that the fit between the anchor clip mounting projections 74 and 76 and the outer shell mounting openings 108 and 109 is such that the anchor clip may be pulled out of the socket by suitable manually applied force. Accordingly, it will be understood that the anchor clips of the present invention are mounted removably to the outer shell 12 whereby the inner impact cap 14, head straps 18 and 19 and head band 22 are mounted removably to the outer shell. This permits the components of the helmet 10 of the present invention to be readily assembled and disassembled and permits individual components to be replaced due to use or damage without the requirement that the entire helmet be replaced in the event that only one or more components are in need of replacement.

Figure 10:
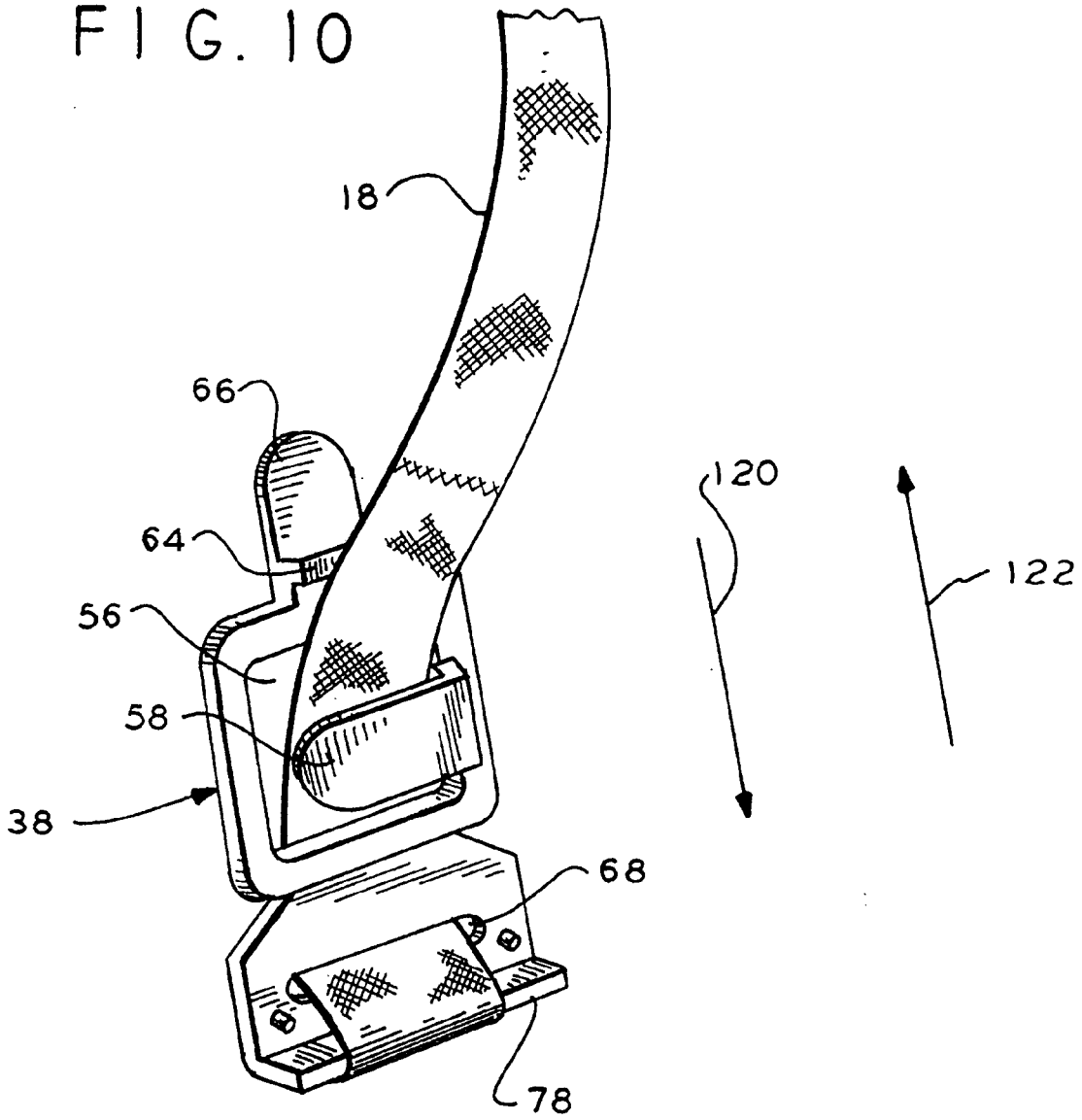
FIG. 10 is a partial view of a head strap and an anchor clip illustrating the application of force to the helmet and a head strap upon, for example, an object falling and striking the helmet.

With regard to the deformability and energy absorption or attenuation provided by the deformable anchor clip cross member 78, reference is made to FIG. 10. In the preferred embodiment of the present invention, the material of which the anchor clips is made is chosen such that the cross member 78 will elastically deform and absorb at least some of the energy produced upon a force being applied to the cross members by the head straps of approximately 200 pounds. Upon an object striking or impacting the outer shell 12, FIG. 1, downwardly acting force indicated by the arrow 120 in FIG. 10 is produced, and since the head straps, e.g. representative head strap 18 in FIG. 8, are mounted to the outer shell, at least a portion of this force will be applied to the head of the wearer of the helmet engaging the web or cradle of straps 16 (FIG. 1). A reaction force indicated by the arrow 122 will be produced in response to the force 120 which reaction force will act upwardly through the head strap 18 pulling it upwardly, as viewed in FIG. 8, with respect to the deformable cross member 78. Upon the forces 120 and 122 becoming sufficiently great, the reaction force 122 will elastically deform the cross member 78 into the opening 68 to absorb or attenuate at least some of the force 120. Alternatively, the material of which the anchor clips are made may be a more rigid material whereby the cross members 78 will not deform and absorb or attenuate such energy and in this embodiment the cross members are only used for mounting with the head straps 18 and 20 (FIG. 1).

Figure 9:
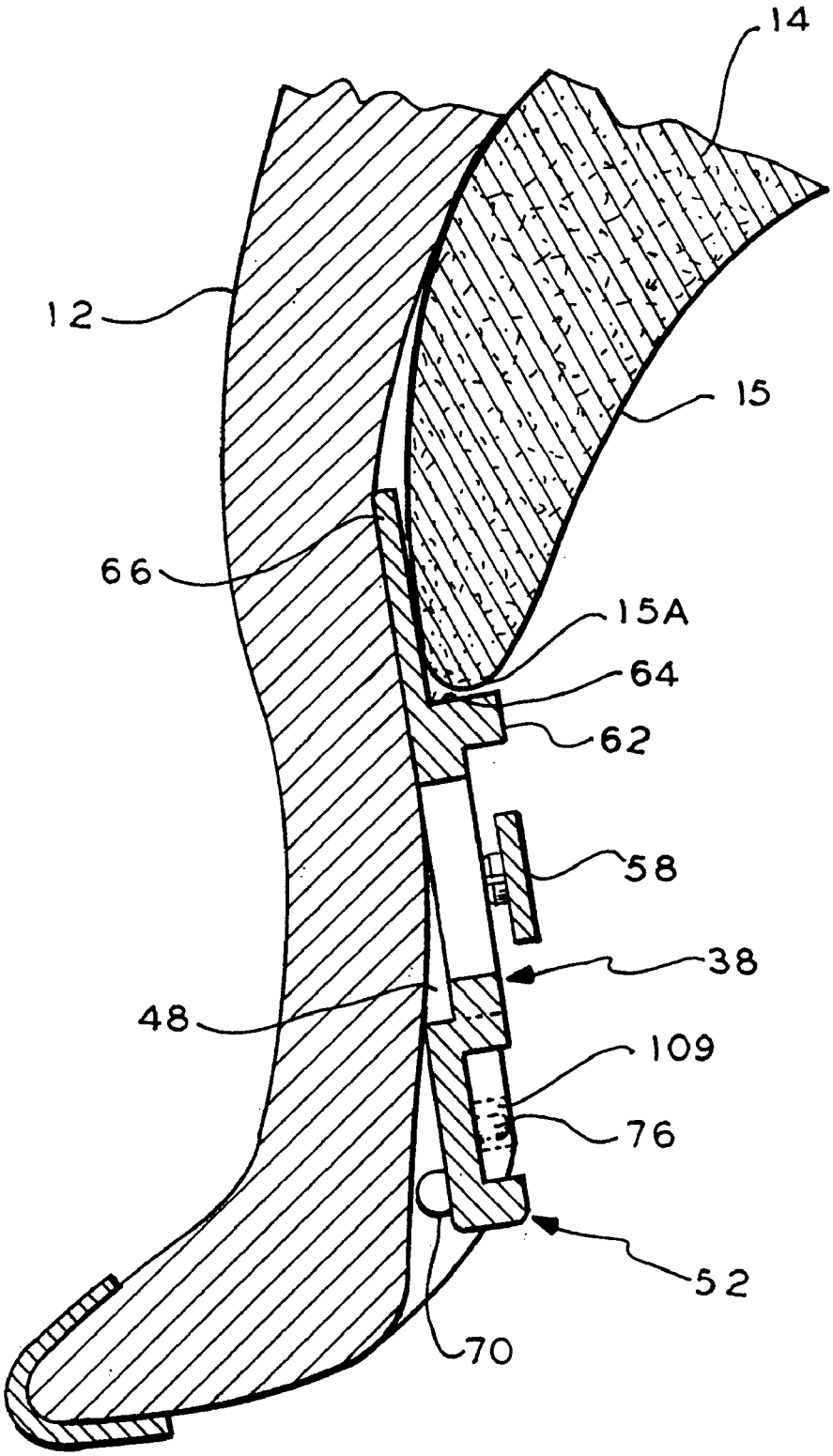
FIG. 9 is a partial view illustrating diagrammatically the mounting of the inner impact cap to the outer shell by an anchor clip.

From FIG. 9, it will be further noted that the outwardly extending anchor clip tab 66 is inserted behind the inner impact cap 14 and between the outer surface of the inner impact cap and the inner surface of the outer shell 12. This insertion and placement of the tab 16 stabilizes the anchor clip 38 in position within the socket 48 and prevents the anchor clip from buckling or bending inwardly upon a force laterally impacting the outer shell 12 and causing the head band 26 to pull away from the outer shell in a direction opposite to the impact force. Referring further to FIG. 10, it will be understood that, upon the reaction force 122 shown in FIG. 10 being present, there will be a tendency for the representative head strap 18 to be pulled upwardly as viewed in FIG. 8 tending to pull the anchor clip 38 inwardly, as viewed in FIG. 7, or tending to buckle the anchor clip. The tab 66 residing between the inner impact cap 14 and outer shell 12 will resist the tendency of the anchor clip to bend inwardly or to buckle and the tab 66 will stabilize the anchor clip in the socket.

With regard to material of which the components of the helmet 10 may be made, FIG. 1, the outer shell 12 may be made of suitable high temperature thermoplastic material such as Ultem available from General Electric Plastics and formed by suitable injection molding. The inner impact cap 19 may be made of suitable rigid polyethylene foam of the type known to the art for protective helmet impact caps and formed by suitable reaction injection molding; the forehead portion 24 of the head band 22 may be made of suitable high density polyethylene and formed by suitable stamping; the nape device 26 of the head band 22 may be made of suitable Nylon available from DuPont and may be formed by injection molding; and the anchor clips 32–36 may be made of Nylon available from DuPont and formed by suitable injection molding. Upon the anchor clips being made of Nylon, the cross member 78, FIGS. 2–4, will be sufficiently elastically deformable to permit the cross members to absorb at least some of the energy produced upon a force being applied to the cross members by the head straps 18 and 19, FIG. 1, of approximately 200 pounds.

Referring again to FIG. 1, the inner impact cap 14 may be provided on a portion of its exterior with a layer of flannel material 140, suitably secured to the impact cap, to provide additional thermal insulation to the impact cap and to the head of a wearer of the helmet 10. Also, the interior 13 of the outer shell 12 may be provided with a plurality of hook or loop patches 132, 142, 143 and 144 which may assist in mounting an ear flap, not shown, to the helmet 10.

With regard to whether or not the anchor clips of the present invention mount the inner impact cap 14 to the outer shell 12, FIG. 1, or at least assist in mounting the inner impact cap to the outer shell, it will be understood that the exterior of the inner impact cap 14, FIG. 1, may be provided with one of hook or loop patches (not shown) and the interior 13 of the outer shell 12, FIG. 1, may be provided with the other of hook or loop patches (not shown) and upon the inner impact cap being inserted into the outer shell, these hook and loop patches would engage and assist in mounting the inner impact cap to the outer shell. In such embodiment, it will be understood that the anchor clips of the present invention would assist such hook and loop patches in mounting the inner impact cap to the outer shell. However, it will be understood, in the preferred embodiment of the present invention, such hook and loop patches are not utilized and the anchor clips of the present invention in the preferred embodiment are used solely to mount the inner impact cap to the outer shell.

Referring again to FIG. 1, the outer shell 12 may be provided with an adjustable chin strap of the type known to the art including a pair of chain strap members 114 and 116 which may be fastened together, in the manner known to the art, to fasten the chin strap and thereby the outer shell under the chin of a wearer of the helmet 10.

It will be understood that many variations and modifications may be made in the present invention without departing from the spirit and the scope thereof.

What is claimed is:

1. Head-protective helmet comprising an outer shell having an interior, an inner impact cap having an interior and a lower outer portion, a plurality of head straps for engaging the head of a wearer of the helmet, a head band for being fitted to the head of a wearer of the helmet, and mounting means for: (i) at least assisting in mounting said inner impact cap to said outer shell and to reside in said interior of said outer shell, (ii) mounting said plurality of head straps directly to said outer shell and to reside in said interior of said inner impact cap, and (iii) mounting said head band directly to said outer shell to reside generally in said lower outer portion of said outer shell.

2. The helmet according to claim 1 wherein said inner impact cap terminates in outer edge and wherein said mounting means provide a plurality of engaging surfaces for engaging at least portions of said outer edge to mount said inner impact cap to said outer shell.

3. The helmet according to claim 1 wherein said mounting means are provided with a plurality of cross members around which the ends of the straps are looped to mount said plurality of head straps to said outer shell.

4. The helmet according to claim 1 wherein said head band is provided with a plurality of openings and wherein said mounting means are provided with a plurality of outwardly extending split snap buttons which are snap fitted into said openings to mount said head band to said outer shell.

5. The helmet according to claim 1 wherein said outer shell is provided with a plurality of inwardly extending sockets, wherein said mounting means comprise a plurality of anchor clips mounted in said sockets, wherein said inner impact cap terminates in an outer edge and wherein said plurality of anchor clips provides a plurality of engaging surfaces for engaging said outer edge to at least assist in mounting said inner impact cap to said outer shell in said interior thereof, wherein said plurality of head straps terminates in a plurality of loops and wherein said plurality of anchor clips provides a plurality of cross members around which said loops are looped to mount said plurality of head straps directly to said outer shell, and wherein said head band is provided with a plurality of first openings and wherein said plurality of anchor clips is provided with a plurality of outwardly extending split snap buttons for being snapped into said first openings to mount said head band directly to said outer shell.

6. The helmet according to claim 5 wherein said sockets are provided with a plurality of projection receiving openings, wherein said plurality of anchor clips includes first and second portions, wherein said first portions are received within said sockets and wherein said first portions are provided with a plurality of projections received in said projection receiving openings to mount said plurality of anchor clips in said sockets, and wherein said first portions are provided with said plurality of cross members, wherein said second portions of said anchor clips are provided with said engaging surfaces for engaging at least portions of said outer edge of said inner impact cap, wherein said second portions are provided with a plurality of stabilizing tabs extending outwardly in a direction opposite said first portions and are inserted between said inner impact cap and said outer shell for preventing said anchor clips from bending inwardly upon a generally downwardly acting force being applied to said outer shell and forcing said head straps downwardly against the head of a wearer of the helmet, wherein said second portions include frames having hollow interiors, wherein said second portions are provided with a plurality of tabs extending generally inwardly from said frames over said hollow interiors and wherein said tabs are provided with said plurality of outwardly extending split snap buttons.

7. The helmet according to claim 1 wherein said mounting means mount said inner impact cap to said outer shell.

8. The helmet according to claim 1 wherein said head band includes a forehead member and a nape device and wherein said forehead member and said nape device are mounted together for pivotal movement with respect to each other.

9. The helmet according to claim 8 wherein said forehead member is generally semi-circular and includes inner ends provided with circular openings and wherein said nape device is generally semi-circular and includes triangular inner ends inserted into said circular openings to mount said forehead member and said nape device together and for pivotal movement with respect to each other.

10. The helmet according to claim 9 wherein said inner ends of said forehead member are provided with slots opening into said circular openings and which slots are for receiving said triangular inner ends of said nape device to facilitate insertion of said triangular inner ends into said circular openings.

11. The helmet according to claim 10 wherein said inner ends of said nape device are provided with indentations for receiving said inner ends of said forehead member to facilitate mounting of said forehead member and said nape device together and pivotally with respect to each other.

12. The helmet according to claim 8 wherein said forehead member is provided with an outwardly extending tab provided with forehead member mounting means and wherein said outer shell is provided with second mounting means and wherein upon said forehead member being pivoted with respect to said nape device said forehead member mounting means and second mounting means are engaged to mount said forehead member at different heights with respect to said outer shell.

13. The helmet according to claim 9 wherein said nape device includes a pair of outwardly extending members provided with a pair of angularly disposed members including nape device mounting means for engaging said mounting means to mount said nape device at different heights with respect to said outer shell upon said nape device being pivoted with respect to said forehead member.

14. The helmet according to claim 13 wherein said mounting means are provided with a plurality of outwardly extending split snap buttons and wherein said nape device mounting means comprise a plurality of associated pairs of openings at different heights with respect to each other and wherein said associated pairs of openings receive said split snap buttons to mount said nape device at different heights with respect to said outer shell.

15. Head-protective helmet comprising an outer shell having an interior and a lower outer portion, an inner impact cap having an interior, a plurality of head straps for engaging the head of a wearer of the helmet, a head band for being fitted to the head of a wearer of the helmet, and mounting means for: (i) at least assisting in mounting said inner impact cap to said outer shell and to reside in said interior of said outer shell, (ii) mounting said plurality of head straps directly to said outer shell and to reside in said interior of said inner impact cap, (iii) mounting said head band directly to said outer shell to reside generally in said lower outer portion of said outer shell, and (iv) for absorbing at least a portion of the energy created upon a generally downwardly acting force striking said outer shell and forcing said plurality of head straps downwardly against the head of a wearer of the helmet.

16. The helmet according to claim 15 wherein said inner impact cap terminates in outer edge and wherein said mounting means provide a plurality of engaging surfaces for engaging at least portions of said outer edge to mount said inner impact cap to said outer shell.

17. The helmet according to claim 15 wherein said mounting means are provided with a plurality of cross members around which the ends of the straps are looped to mount said plurality of head straps directly to said outer shell.

18. The helmet according to claim 15 wherein said head band is provided with a plurality of openings and wherein said mounting means are provided with a plurality of outwardly extending split snap buttons which are snap fitted into said openings to mount said head band directly to said outer shell.

19. The helmet according to claim 17 wherein said mounting means are provided with a plurality of openings partially defined by said cross members and wherein said cross members are deformable cross members and are deformed into said openings upon said plurality of head straps being forced downwardly against the head of a wearer of the helmet.

20. The helmet according to claim 15 wherein said outer shell is provided with a plurality of inwardly extending sockets, wherein said mounting means comprise a plurality of anchor clips mounted in said sockets, wherein said inner impact cap terminates in an outer edge and wherein said plurality of anchor clips provides a plurality of engaging surfaces for engaging said outer edge to at least assist in mounting said inner impact cap to said outer shell in said interior thereof, wherein said plurality of head straps terminates in a plurality of loops and wherein said plurality of anchor clips provides a plurality of cross members around which said loops are looped to mount said plurality of head straps to said outer shell, and wherein said head band is provided with a plurality of first openings and wherein said plurality of anchor clips is provided with a plurality of outwardly extending split snap buttons for being snapped into said first openings to mount said head band to said outer shell, wherein said plurality of anchor clips is provided with a plurality of second openings adjacent said cross members and into which second openings said cross members are deformed to absorb at least a portion of said energy.

21. The helmet according to claim 20 wherein said sockets are provided with a plurality of projection receiving openings, wherein said plurality of anchor clips includes first and second portions, wherein said first portions are received within said sockets and wherein said first portions are provided with a plurality of projections received in said projection receiving openings to mount said plurality of anchor clips in said sockets, and wherein said first portions are provided with said plurality of cross members, wherein said second portions of said anchor clips are provided with said engaging surfaces for engaging at least portions of said outer edge of said inner impact cap, wherein said second portions are provided with a plurality of stabilizing tabs extending outwardly in a direction opposite said first portions and are inserted between said inner impact cap and said outer shell for preventing said anchor clips from bending inwardly upon said generally downwardly acting force being applied to said head straps, wherein said second portions include frames having hollow interiors, wherein said second portions are provided with a plurality of tabs extending generally inwardly from said frames over said hollow interiors and wherein said tabs are provided with said plurality of outwardly extending split snap buttons.

22. The helmet according to claim 15 wherein said head band includes a forehead member and a nape device and wherein said forehead member and said nape device are mounted directly to each other for pivotal movement with respect to each other.

23. The helmet according to claim 22 wherein said forehead member is generally semi-circular and includes inner ends provided with circular openings and wherein said nape device is generally semi-circular and includes triangular inner ends inserted into said circular openings to mount said forehead member and said nape device directly to each other and for pivotal movement with respect to each other.

24. The helmet according to claim 23 wherein said inner ends of said forehead member are provided with slots opening into said circular openings and which slots are for receiving said triangular inner ends of said nape device to facilitate insertion of said triangular inner ends into said circular openings.

25. The helmet according to claim 24 wherein said inner ends of said nape device are provided with indentations for receiving said inner ends of said forehead member to facilitate mounting of said forehead member and said nape device directly to each other and pivotally with respect to each other.

26. The helmet according to claim 23 wherein said forehead member is provided with an outwardly extending tab provided with forehead member mounting means and wherein said outer shell is provided with second mounting means and wherein upon said forehead member being pivoted with respect to said nape device said forehead member mounting means and second mounting means are engaged to mount said forehead member at different heights with respect to said outer shell.

27. The helmet according to claim 23 wherein said nape device includes a pair of outwardly extending members provided with a pair of angularly disposed members including nape device mounting means for engaging said mounting means to mount said nape device at different heights with respect to said outer shell upon said nape device being pivoted with respect to said forehead member.

28. The helmet according to claim 27 wherein said mounting means are provided with a plurality of outwardly extending split snap buttons and wherein said nape device mounting means comprise a plurality of associated pairs of openings at different heights with respect to each other and wherein said associated pairs of openings receive said split snap buttons to mount said nape device at different heights with respect to said outer shell.

29. Head-protective helmet comprising an outer shell having an interior and being provided with a plurality of inwardly extending sockets, a hollow, deformable, generally semi-hemispheric inner impact cap having an interior and terminating in an outer edge, and a plurality of anchor clips mounted in said sockets, said plurality of anchor clips providing a plurality of engaging surfaces for engaging said outer edge of said inner impact cap to at least assist in mounting said inner impact cap to said outer shell in said interior thereof.

30. The head-protective helmet according to claim 29 wherein said helmet includes a plurality of head straps for engaging the head of the wearer of the helmet, said head straps including a plurality of outer ends mounted to said plurality of anchor clips and wherein said anchor clips mount said plurality of head straps directly to said outer shell.

31. The head-protective helmet according to claim 29 wherein said helmet further includes a head band for being fitted to the head of a wearer of the helmet and wherein said head band is mounted to said anchor clips and wherein said anchor clips mount said head band directly to said outer shell.

32. The head-protective helmet according to claim 30 wherein said plurality of anchor clips include means for absorbing at least a portion of the energy created upon a generally downwardly acting force striking said outer shell and forcing said plurality of head straps downwardly against the head of a wearer of said helmets.

33. Head protective helmet according to claim 29 wherein said plurality of anchor clips mount said inner impact cap to said outer shell and said interior thereof.

34. The head-protective helmet according to claim 29 wherein each of said anchor clips comprise integrally formed first and second portions, said first portion including an outer rectangular portion and an inner trapezoidal portion formed integrally with said second portion, said second portion including an inner generally rectangular frame having a hollow interior and including a lateral frame leg, a first tab formed integrally with and extending generally inwardly from said lateral leg over said hollow interior, said first tab provided with an outwardly extending split snap button, said second portion further including an outer second tab formed integrally with and extending outwardly from said frame generally opposite said second portion.

35. The helmet according to claim 31 wherein said head band includes a forehead member and a nape device and wherein said forehead member and said nape device are mounted directly to each other for pivotal movement with respect to each other.

36. The helmet according to claim 35 wherein said forehead member is generally semi-circular and includes inner ends provided with circular openings and wherein said nape device is generally semi-circular and includes triangular inner ends inserted into said circular openings to mount said forehead member and said nape device directly to each other and for pivotal movement with respect to each other.

37. The helmet according to claim 36 wherein said inner ends of said forehead member are provided with slots opening into said circular openings and which slots are for receiving said triangular inner ends of said nape device to facilitate insertion of said triangular inner ends into said circular openings.

38. The helmet according to claim 37 wherein said inner ends of said nape device are provided with indentations for receiving said inner ends of said forehead member to facilitate mounting of said forehead member and said nape device directly to each other and pivotally with respect to each other.

39. The helmet according to claim 36 wherein said forehead member is provided with an outwardly extending tab provided with forehead member mounting means and wherein said outer shell is provided with second mounting means and wherein upon said forehead member being pivoted with respect to said nape device said forehead member mounting means and second mounting means are engaged to mount said forehead member at different heights with respect to said outer shell.

40. The helmet according to claim 35 wherein said nape device includes a pair of outwardly extending members provided with a pair of angularly disposed members including nape device mounting means for engaging a pair of said anchor clips to mount said nape device at different heights with respect to said outer shell upon said nape device being pivoted with respect to said forehead member.

41. The helmet according to claim 40 wherein said pair of anchor clips are provided with a pair of outwardly extending split snap buttons and wherein said nape device mounting means comprise a plurality of associated pairs of openings at different heights with respect to each other and wherein said associated pairs of openings receive said pair of split snap buttons to mount said nape device at different heights with respect to said outer shell.

42. Mounting member comprising integrally formed first and second portions, said first portion including an outer rectangular portion and an inner trapezoidal portion formed integrally with said second portion, said second portion including an inner generally rectangular frame having a hollow interior and including a lateral frame leg, a first tab formed integrally with and extending generally inwardly from said lateral leg over said hollow interior, said first tab provided with an outwardly extending split snap button, said second portion further including an outer second tab formed integrally with and extending outwardly from said frame generally opposite said first portion.

* * * * *